US005915865A

United States Patent [19]

Wade

[11] Patent Number: 5,915,865

[45] **Date of Patent: *Jun. 29, 1999**

[54] METHOD AND APPARATUS FOR COMPENSATING FOR PRINTER TOP-OF-FORM AND IMAGE STRETCH ERRORS

[75] Inventor: Joseph R. Wade, Monroe, Wash.

[73] Assignee: Intermec IP Corp., Beverly Hills, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/759,576

[22] Filed: Dec. 5, 1996

[51] Int. Cl.[6] ..... B41J 11/42

[52] U.S. Cl. ..... 400/709; 400/104; 400/568; 400/613.1; 400/707.1; 400/902

[58] Field of Search ..... 400/68, 103, 104, 400/902, 555, 568, 613, 613.1, 583, 706, 707, 707.1, 708, 708.1, 709

[56] References Cited

U.S. PATENT DOCUMENTS

| | | | |
|---|---|---|---|
| 4,311,399 | 1/1982 | Wegryn et al. | 400/902 |
| 4,591,969 | 5/1986 | Bloom et al. | 400/902 |
| 4,661,001 | 4/1987 | Takai et al. | 400/103 |
| 4,699,531 | 10/1987 | Ulinski, Sr. et al. . | |
| 4,795,281 | 1/1989 | Ulinski, Sr. et al. | 400/103 |
| 4,936,693 | 6/1990 | Ohsawa | 400/104 |
| 4,960,336 | 10/1990 | Brooks et al. | 400/103 |
| 5,056,429 | 10/1991 | Hirosaki | 400/103 |
| 5,061,946 | 10/1991 | Helmbold et al. . | |
| 5,061,947 | 10/1991 | Morrison et al. . | |
| 5,207,516 | 5/1993 | Suzuki | 400/555 |
| 5,297,871 | 3/1994 | Fujioka | 400/568 |
| 5,322,380 | 6/1994 | Crocker . | |
| 5,335,837 | 8/1994 | Saeki et al. . | |
| 5,480,244 | 1/1996 | Senda . | |
| 5,492,423 | 2/1996 | Smith . | |
| 5,498,087 | 3/1996 | Wey et al. . | |

FOREIGN PATENT DOCUMENTS

| | | | |
|---|---|---|---|
| 0406984 | 1/1991 | European Pat. Off. . | |
| 0488406 | 6/1992 | European Pat. Off. . | |
| 55-32603 | 3/1980 | Japan . | |
| 58-72239 | 4/1983 | Japan | 400/68 |
| 60-187570 | 9/1985 | Japan . | |
| 01232086 | 9/1989 | Japan . | |
| 2-305666 | 12/1990 | Japan . | |
| 06055758 | 3/1994 | Japan . | |

*Primary Examiner*—Christopher A. Bennett
*Attorney, Agent, or Firm*—Graham & James LLP

[57] ABSTRACT

An apparatus and method for controlling operation of a printer enables the transport rate of the print media to be coordinated with the print rate in order to precisely compensate for top-of-form and image stretch errors. The printer comprises a platen roller driven by a stepper motor to transport the print media in step increments. A print head is disposed in proximity to the platen roller so that the print media is transported therebetween by operation of the platen roller and step motor. A step rate control circuit for the printer comprises a clock adapted to provide a series of regular clock pulses at a fixed rate, and a first and a second counter respectively coupled to the clock for counting the clock pulses. The first counter provides a first interrupt signal with each of a first number of clock pulses which is provided to the stepper motor to cause the print media to be advanced by one step. The second counter provides a second interrupt signal with each of a second number of clock pulses which is provided to the print head to activate the printing of a line of information onto the print media. By selecting the first number and the second number, the printer can provide optimum registration of the printed information to the print media.

16 Claims, 3 Drawing Sheets

METHOD AND APPARATUS FOR COMPENSATING FOR PRINTER TOP-OF-FORM AND IMAGE STRETCH ERRORS

BACKGROUND OF THE INVENTION

1. Field of the Invention

The present invention relates to thermal printing, and more particularly, to a method and apparatus for coordinating transport rate and print rate of a print media within a thermal printer in order to compensate for top-of-form and image stretch errors.

2. Description of Related Art

In the field of bar code symbology, vertical bars of varying thicknesses and spacing are used to convey information, such as an identification of the object to which the bar code is affixed. The bar code symbols are typically printed onto labels having an adhesive backing layer that enables the labels to be affixed to objects to be identified. To read a bar code symbol, the bar and space elements are often scanned by a light source, such as a laser. Since the bar and space elements have differing light reflective characteristics, the information contained in the bar code can be read by interpreting the laser light that reflects from the bar code. Alternatively, a bar code symbol may be imaged by an electrically photosensitive element, such as a charge coupled device (CCD), and the individual bar and space elements identified from within a one or two-dimensional electronic image of the bar code symbol. In order to accurately read the bar code symbol, it is thus essential that the symbol be printed in a high quality manner, without any streaking, blurring or improper registration of the symbols to the labels. At the same time, it is essential that the adhesive backing layer of the labels not be damaged by heat generated during the printing process.

In view of these demanding printing requirements, bar code symbols are often printed using direct thermal or thermal transfer printing techniques. In direct thermal printing, the print media is impregnated with a thermally sensitive chemical that reacts upon exposure to heat. In thermal transfer printing, a thermally reactive ribbon is transported in parallel with the print media, and ink from the ribbon is transferred to the print media upon exposure to heat. Both of these printing techniques are referred to collectively herein as thermal printing.

Under either method of thermal printing, the print media is drawn between a platen and a thermal print head by a media transporting mechanism. The transporting mechanism may include stepper motors that transport the print media in small incremental steps of as little as five mils per step. The thermal print head has linearly disposed printing elements that extend across a width dimension of the print media. The printing elements are individually activated in accordance with instructions from a controller, which activates the thermally reactive chemical of the print media or ribbon at the location of the particular printing element. As the print media is drawn in a step-wise manner through the region defined between the platen and the thermal print head, the bar code symbols are printed onto the print media as it passes therethrough. Other images, such as text, graphics or symbols, can also be printed onto the print media in the same manner.

The print media may comprise a release liner onto which the successive labels are affixed. The release liner has a coating that permits the labels to be easily removed therefrom without adhering permanently, and which enables the labels to be effectively transported through the print region without sticking to various elements of the transporting mechanism. There is usually a small gap between adjacent ones of the labels which is used to separate the labels and to provide a guide for registration of the printed information to the labels, as further described below. Alternatively, the print media may comprise a non-adhesive card or tag stock having periodic indentations at opposite sides thereof which are joined by perforation lines. The indentations and perforation lines define gaps for registration of the printed information in a similar manner as the adhesive labels. Further, the adhesive or non-adhesive labels may also have preprinted information, such as color graphics, that is intended to be aligned with the printed information applied by the thermal printer.

It is desirable within the art to maximize the amount of information printed on each label, and conversely, to reduce the amount of unused space on the labels. It is also desirable to avoid undesired misregistration of printed information to a respective label. To accomplish these goals, it is necessary to identify with a high degree of accuracy the leading edge of each label on the print media in order to synchronize the printing with the transport of the print media. Ideally, the gap between the adjacent labels is a constant width, however, in practice, there are inevitable variations in the gap width due to differences in print media production quality as well as stretching of the print media during its transport. For the printed information to begin as close as possible to the leading edge, it is necessary that the leading edge of the labels be identified within a single step size of the print media transporting mechanism. A discrepancy between the start of the printed information and the leading edge of the label is referred to herein as a top-of-form registration error.

As known in the art, gap sensor circuits are used to identify the gap between adjacent labels of the print media. A conventional gap sensor circuit comprises a photosensor having a light emitting element and a light receiving element. The photosensor is disposed relative to the print media with the light emitting and receiving elements positioned at opposite sides of the print media thereof so that light passes through the print media as it is transported. Since the non-gap regions of the print media will transmit less light than the gap regions, the gap can be detected by measuring the change in light transmissivity of the print media as it passes between the two photosensor elements. The conventional gap sensor circuits permit the thermal printer to limit top-of-form registration errors to a single step size of the print media. Even though the maximum top-of-form error is very small, however, it is still noticeable and is thus undesirable.

An additional problem relating to image registration is referred to herein as image stretch. As the size of the print media roll or thermal transfer ribbon changes from beginning to end, the amount of back pressure or drag applied to the media transporting mechanism changes in a generally corresponding manner. This variation in drag results in variation of the effective step size of the print media. Similarly, a step size variation may also be caused by changes in the mechanical systems of the printer, such as by replacement of the platen roller. Moreover, the slight differences in mechanical tolerances between otherwise identical printers will often result in non-uniformity of the step size. As the step size increases, the printed information may become elongated or distorted. These image stretch errors are not only aesthetically unsatisfactory, in some cases the image stretch may render the printed bar code symbols unreadable. Also, image stretch errors may further exacerbate top-of-form registration errors.

Thus, it would be desirable to provide a method and apparatus for closely coordinating the transport rate of a thermal print media with its print rate in order to precisely compensate for top-of-form and image stretch errors.

SUMMARY OF THE INVENTION

In accordance with the teachings of the present invention, a method and apparatus for controlling operation of a thermal printer is provided, in which the transport rate of the print media is coordinated with the print rate in order to precisely compensate for top-of-form and image stretch errors.

Particularly, the printer comprises a platen roller driven by a stepper motor to transport the print media in step increments. A print head is disposed in proximity to the platen roller so that the print media is transported therebetween by operation of the platen roller and the stepper motor. A step rate control circuit for the printer comprises a clock adapted to provide a series of regular clock pulses at a fixed rate, and a first and a second counter respectively coupled to the clock for counting the clock pulses. The first counter provides a first interrupt signal with each of a first number of clock pulses. The first interrupt signal is provided to the stepper motor to cause the print media to be advanced by one step. The second counter provides a second interrupt signal with each of a second number of clock pulses. The second interrupt signal is provided to the print head to activate the printing of a line of information onto the print media. By selecting the first number and the second number, the printer can provide optimum registration of the printed information to the print media.

A more complete understanding of the method and apparatus for compensating for printer top-of-form and image stretch errors will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention satisfies the need for a method and apparatus for closely coordinating the transport rate of a print media with its print rate in order to precisely compensate for top-of-form and image stretch errors. In the detailed description that follows, it should be appreciated that like element numerals are used to describe like elements illustrated in one or more of the figures.

Figure 1:
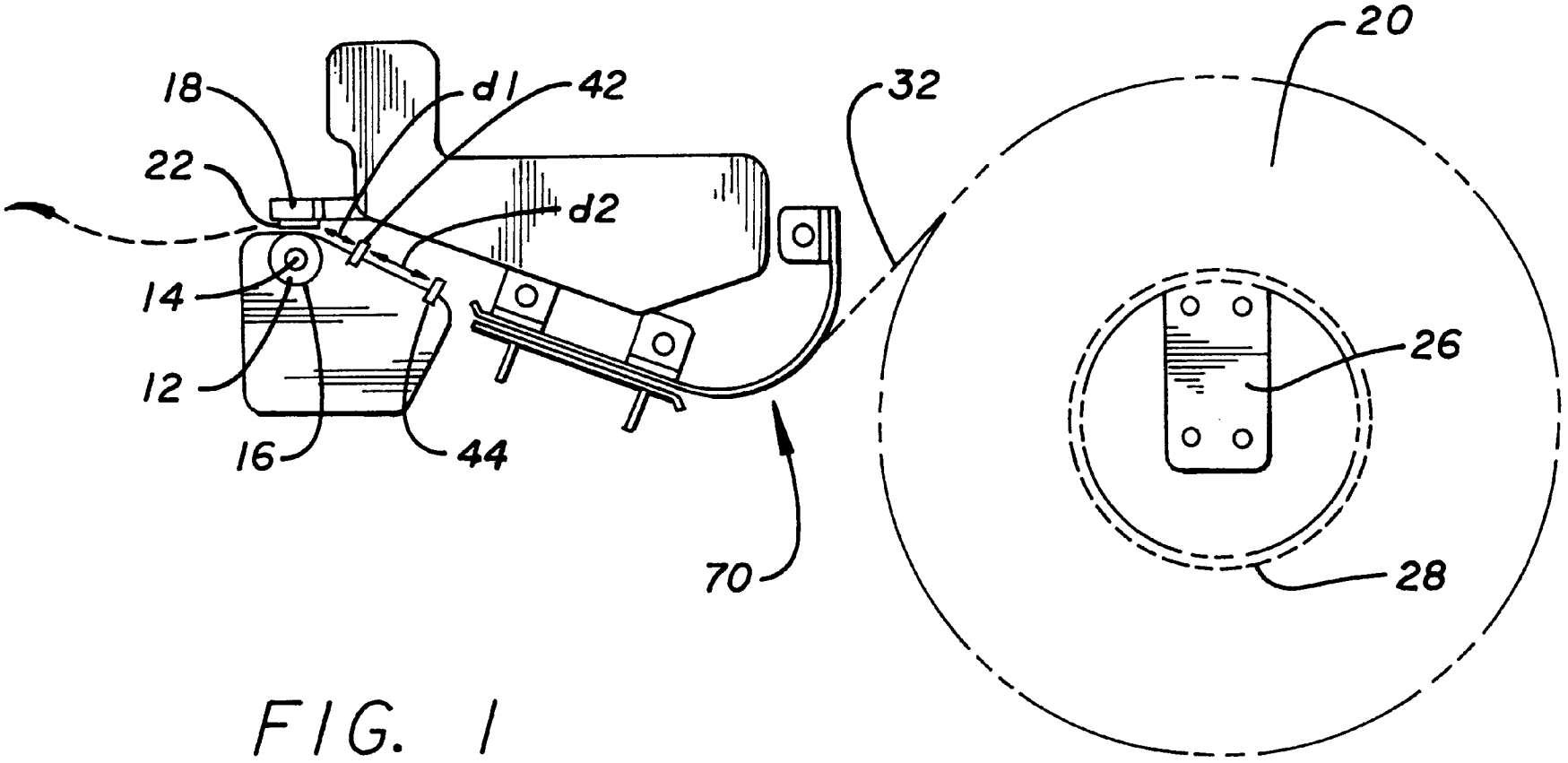
FIG. 1 is a side view of a thermal printer illustrating a print media being transported through a thermal print region.

Referring first to FIG. 1, a side view of a direct thermal printer is illustrated. It should be noted that the illustrated embodiment of the direct thermal printer is similar to that of a thermal transfer printer, except that a thermal transfer printer would also require a separate transporting mechanism to control movement of a transfer ribbon. Since those aspects of a thermal transfer printer are otherwise not pertinent to the present invention, further description herein is omitted for simplicity. Nevertheless, it should be appreciated that the teachings of the present invention are equally applicable to thermal transfer printing as well as direct thermal printing.

The printer includes a platen 12 having a protruding end axle 14 and a roller surface 16. The axle 14 provides for support of the platen 12 at opposite ends thereof. The platen 12 is rotatable about the axle 14 by use of an external driving force, such as provided by a stepper motor coupled directly to the platen or through a gear or belt. A thermal print head 18 is disposed adjacent to the platen 12, and has a linear row of print elements disposed along a surface 22 that faces the roller surface 16. A print region is defined between the surface 22 of the thermal print head 18 and the roller surface 16 of the platen 12. The thermal print head 18 receives electrical signals that control the sequence of activation of the individual print elements to effect the printing of desired information onto a print media, as will be further described below. Rotation of the platen 12 under control of the external driving force will draw the print media through the print region in a step-wise manner, that will also be described below.

A media supply hub 26 extends substantially parallel to the platen 12 and supports a roll of print media 20. The print media roll 20 comprises a web 32 of print media material wound onto a core 28. The media supply hub 26 may further include a roller that enables the print media roll 20 to rotate freely and accelerate rapidly in response to take-up pressure applied by the platen 12. The media supply hub 26 has a cross-section sufficiently smaller than the core 28 of the print media roll 20 so that it can accommodate print media rolls of varying sizes. At an outside diameter of the print media roll 20, the print media web 32 trails off the roll and is drawn toward the print region by rotation of the platen 12. A mechanical guide 70 may be used to further define the path of the print media web 32 as it travels between the roll 20 and the print region.

The printer further includes two gap sensors 42, 44, as illustrated in FIG. 1. The first gap sensor 42 is disposed a fixed distance d1 prior to the thermal print head 18, and the second gap sensor 44 is disposed a fixed distance d2 prior to the first gap sensor. Preferably, the first gap sensor 42 should be disposed as close as possible to the thermal print head 18, so that the distance d1 is minimized. As a practical matter, however, the first gap sensor 42 cannot be disposed too close to the thermal print head 18 in order to avoid interference with the operation of the thermal print head. As will be further described below, the second gap sensor 44 is optional and is not used in an embodiment of the invention.

Figure 2:
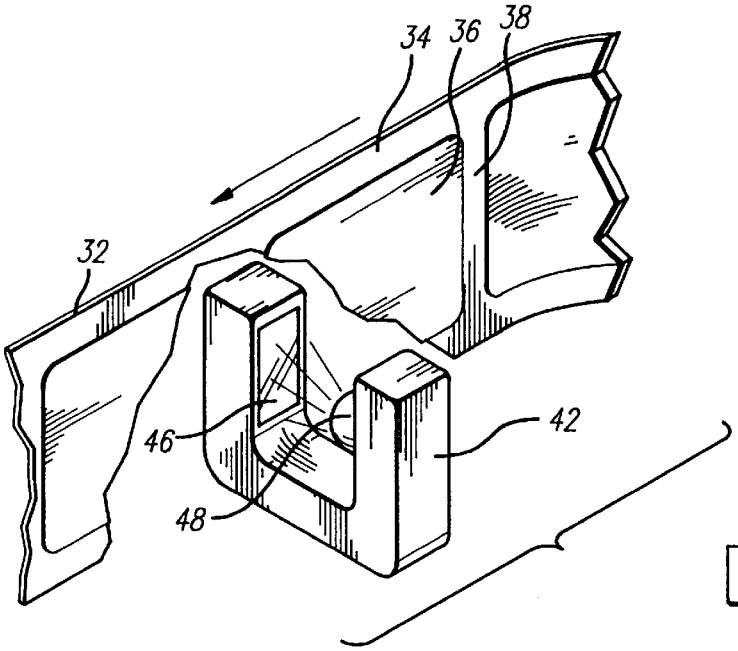
FIG. 2 is an enlarged view of a portion of the thermal printer of FIG. 1 illustrating the print media passing through a gap sensor.

Referring now to FIG. 2, an enlarged view of the thermal printer illustrates the print media web 32 passing through the first gap sensor 42. The second gap sensor 44 is substantially identical to the first gap sensor 42, and thus is not illustrated in detail. The print media comprises a release liner 34 having a glossy or non-stick surface onto which a plurality of labels 36 are affixed. The labels 36 each comprise a paper substrate material having an exposed surface onto which information is printed and an adhesive surface opposite the exposed surface. For direct thermal printing, the paper substrate is impregnated with a thermally active chemical that reacts with heat provided by the thermal head to permit the printing of information thereon. For thermal transfer printing, thermally active ink is transferred to the paper substrate from a thermally reactive ribbon (not shown). The adhesive surface permits the labels 36 to remain affixed to the release liner 34 as they are transported through the printer in a conventional manner; however, the labels can be easily removed from the release liner after printing. Alternatively, the print media 20 may be non-adhesive or may contain perforations or other types of separation lines that permit the print media web to be subdivided into individually removable labels, cards or tags.

The labels 36 have a generally rectangular shape with gaps 38 provided between respective leading and trailing edges of adjacent ones of the labels, such that the release liner 34 is exposed at the gaps. The width of each gap 38, or the spacing between adjacent ones of the labels 36, is ideally a constant for a particular type of print media. In actual practice, however, the gaps 38 do not always have a uniform width. Therefore, gap sensors are provided with the printer to accurately differentiate between the labels 36 and the gaps 38 so that printing can begin as close as possible to the leading edge of a label in order to minimize top-of-form registration errors. The release liner 34 and the labels 36 of the print media 20 permit a certain amount of light to pass therethrough, though it should be apparent that the label regions of the print media at which the labels are affixed are generally more opaque, i.e., less light transmissive, than the gap regions. Moreover, the light transmissivity of the respective gap and label regions will vary considerably between assorted types of print media due to differences in material composition, color and manufacturing standards. Accordingly, the gap sensors identify the gaps 38 by detecting the difference in light transmissivity of the print media 20 as it is transported by operation of the platen 12 described above.

The gap sensor 42 includes a U-shaped housing that defines a slotted region through which the print media web 32 is transported. A first inner surface of the slotted region includes a light emitting element 48, and a second inner surface of the slotted region includes a light receiving element 46. The light emitting element 48 and light receiving element 46 are disposed so that they face each other across the slotted region. The light emitting element 48 may be provided by a conventional light emitting diode (LED) or photodiode, and the light receiving element 46 may be provided by a conventional phototransistor. The light emitted by the light emitting element 48 is transmitted through the print media web 32 and is received by the light receiving element 46. An example of a gap sensor adapted for use in the present invention is disclosed in copending patent application Ser. No. 08/700,158, entitled SELF-CALIBRATING LABEL GAP SENSOR, filed Aug. 20, 1996.

Figure 3:
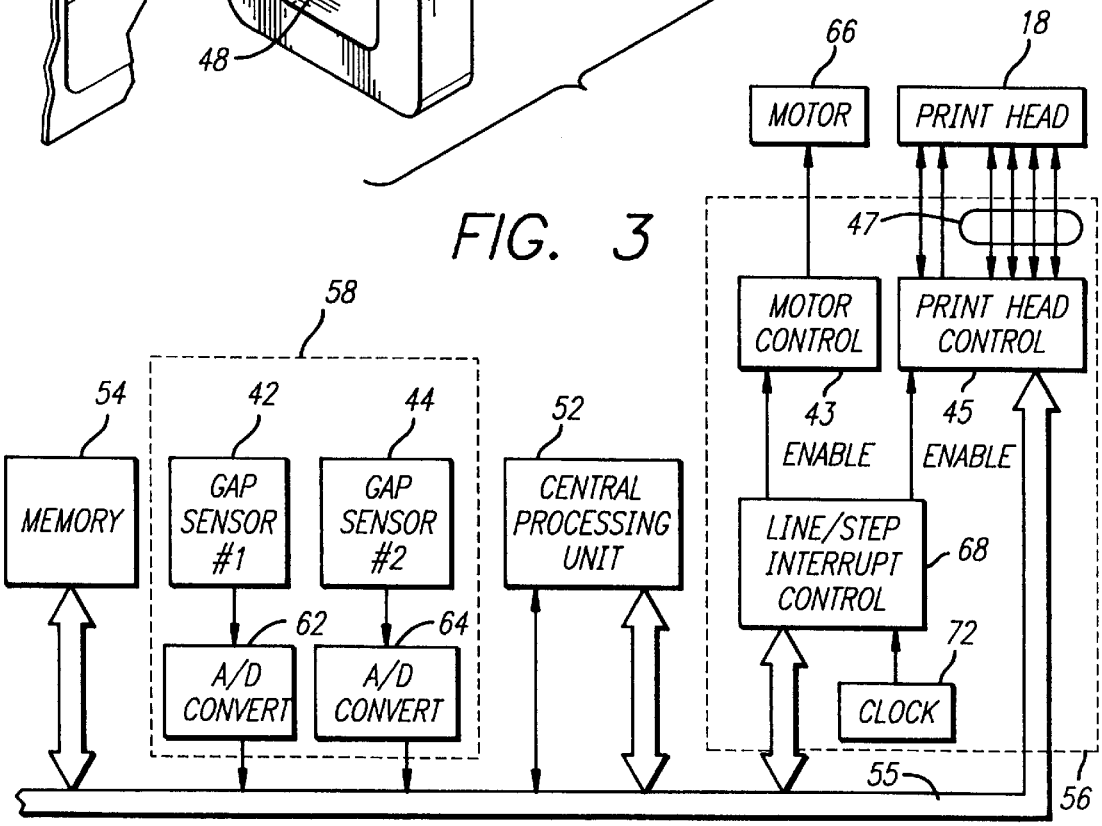
FIG. 3 is a functional block diagram of the thermal printer including a compensation control circuit of the present invention.

Referring now to FIG. 3, a functional block diagram of a thermal printer is provided. The printer includes a central processing unit (CPU) 52, a memory 54, a print control section 56, and a data input section 58. Each of these elements of the printer are coupled together by a bi-directional data and control bus 55, over which data and control messages are transmitted. The CPU 52 controls the overall operation of the printer, and may be provided by a conventional microprocessor, microcontroller or digital signal processor circuit. The memory 54 provides data storage for operation of the CPU 52, and may be comprised of conventional read only memory (ROM) devices to provide for non-volatile data storage and random access memory (RAM) devices to provide for temporary data storage. For example, the memory 14 provides for non-volatile storage of an instruction set, i.e., software, that is executed in a sequential manner by the CPU 52 to control the overall operation of the printer.

The data input section 58 manages the flow of information regarding the movement of the print media to the CPU 52. Specifically, the data input section 58 receives analog input signals from the two gap sensors 42, 44 described above. Analog-to-digital (A/D) converters 62, 64 are respectively coupled to the two gap sensors 42, 44, which convert the analog signals to binary values that are provided to the CPU 52 on the bi-directional data and control bus 55. The CPU 52 uses the data received from the gap sensors 42, 44 regarding the gaps 38 between the adjacent ones of the labels 36 to control the timing of printing operations.

The print control section 56 is coupled to a stepper motor 66 and the thermal print head 18. The stepper motor 66 is mechanically coupled to the platen 12 described above to advance the print media web 32 in step increments. The print control section 56 comprises a motor control unit 43, a print head control unit 45, a line/step interrupt control unit 68, and a clock 72. The motor control unit 43 provides current signals to the stepper motor 66 which causes the motor to rotate by a fixed amount, and in turn, drive the print media web 32 an amount that is ideally a fixed distance. The print head control unit 45 provides various signals to the thermal print head to control aspects such as activation timing, duration and temperature of the individual printing elements. The line/step interrupt control unit 68 provides respective interrupt signals to the motor control unit 43 and the print head control unit 45 which control the timing of the printing operations. Specifically, an interrupt signal provided by the line/step interrupt control unit 68 to the motor control unit 43 will cause the stepper motor 66 to advance by one step increment, and an interrupt signal provided by the line/step interrupt control unit 68 to the print head control unit 45 will cause the print head 18 to print one line of information. The motor control unit 43, print head control unit 45 and line/step interrupt control unit 68 may be provided by special function electronic devices, such as an application specific integrated circuit (ASIC), that is accessed by the CPU 52 through the data and control bus 55.

The CPU 52 also provides binary data directly to the print head control unit 45 through the data and control bus 55 which defines the information to be printed by the thermal print head 18 onto the print media. In turn, the print head control unit 45 provides binary address and data information to the thermal print head 18 over a multi-bit bus 47. Each of the printing elements of the thermal print head 18 has a unique address that is selected by the print head control unit 45, and a printing data value for the particular address is selected for every printing operation. The data value defines the printing characteristics of the printing elements in terms of its temperature and time duration. The print head control unit 45 may keep track of various other parameters useful for controlling the printing operations, such as a thermal history of each of the printing elements.

Figure 5:
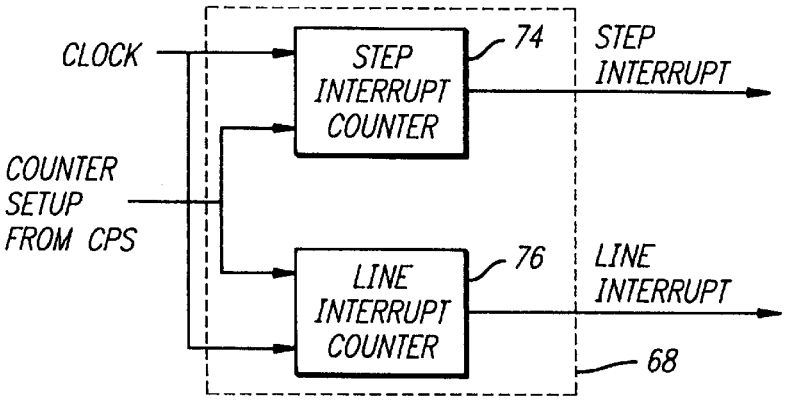
FIG. 5 is a functional block diagram of the compensation control circuit of FIG. 3.

Referring now to FIG. 5, the line/step interrupt control unit 68 is illustrated in greater detail. The line/step interrupt control unit 68 comprises a step interrupt counter 74 and a line interrupt counter 76. Both the step interrupt counter 74 and the line interrupt counter 76 are commonly coupled to the clock 72 which provides a periodic clock signal at a relatively high clock rate. The step interrupt counter 74 and the line interrupt counter 76 also receive respective counter set-up values from the CPU 52. The step interrupt counter 74 and the line interrupt counter 76 count individual cycles of the clock signal and issue respective interrupt signals upon reaching the respective counter set-up values designated by the CPU 52. Accordingly, by varying the counter set-up values, the step rate of the stepper motor 66 can be synchronized to the line print rate of the thermal print head 18.

Figure 4:
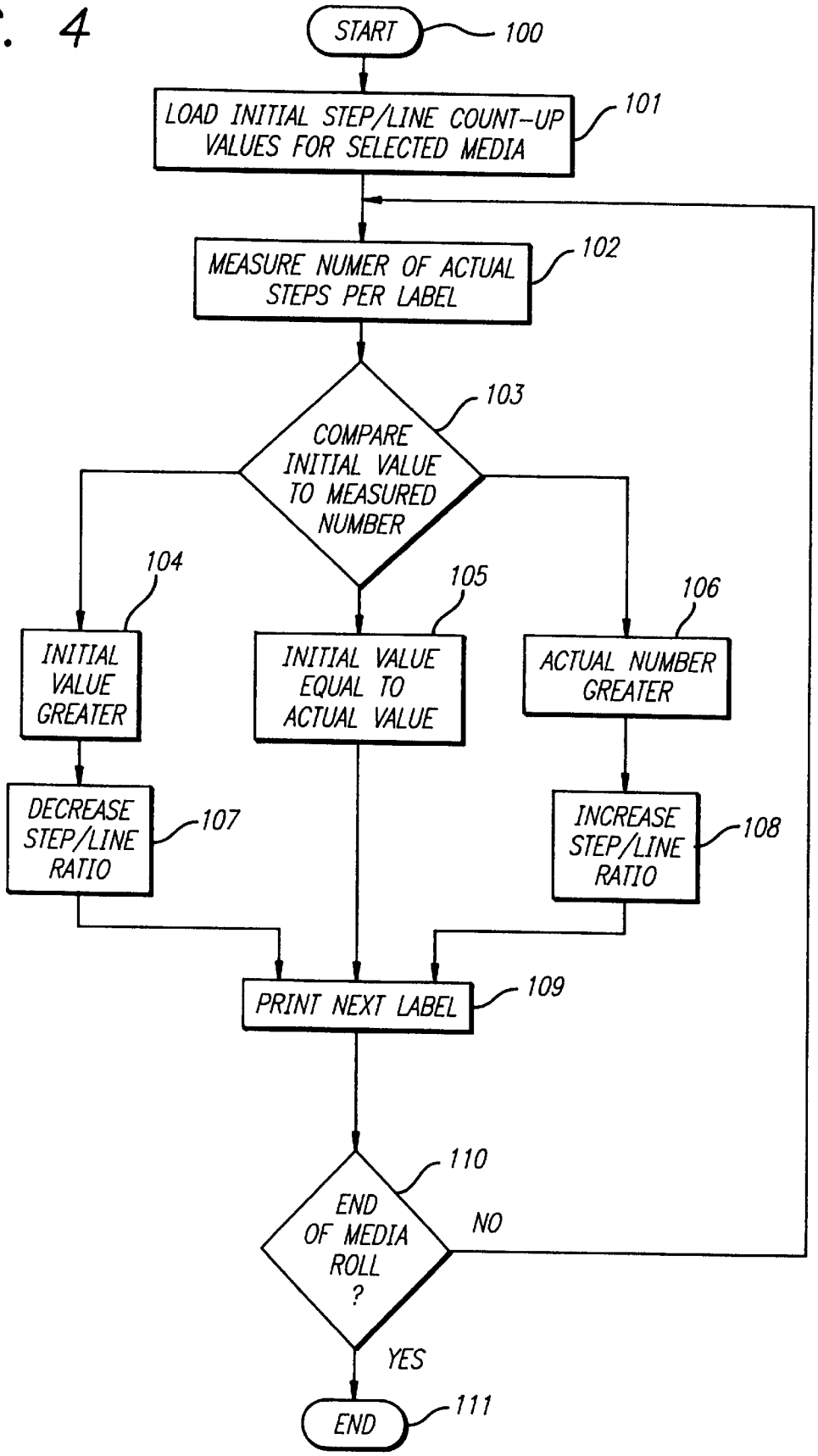
FIG. 4 is a flow chart illustrating a compensation control method of the present invention.

A compensation control method of the present invention is illustrated at FIG. 4. The method is initiated at step 100, and at step 101, initial step and line count-up values are loaded by the CPU 52 into the line/step interrupt control unit 68 for a selected type of thermal print media. Since each type of thermal print media has differing characteristics in terms of size, density, label width/length, and gap spacing, the step rate and line print rate for the particular print media would differ accordingly. It is anticipated that a particular type of print media would include suggested initial count-up values in documentation that accompanies the print media, thus enabling the operator of the printer to enter the initial count-up values into a control panel of the printer at the time a new printing job is initiated. If the print media does not have suggested initial count-up values, then initial default values will be provided by the CPU 52. As will be appreciated from the description that follows, the default values will be modified by operation of the present compensation control method to provide optimum values.

For exemplary purposes, initial default count-up values for the step and line counts are each respectively set at one-hundred. Accordingly, the motor control unit 43 and the print head control unit 45 will issue respective interrupt signals to the stepper motor 66 and the print head 18 once every one-hundred clock cycles from the clock 72. It should be understood that a greater or lesser number could be selected for the initial default count-up values.

At step 102, the length of an individual label 36 is measured in terms of a count of actual steps by the stepper motor 66 (described above). In a first embodiment of the present invention, a single gap sensor 42 is utilized to perform the length measurement. When the gap sensor 42 detects a transition between a gap and a leading edge of a label 36 and provides that information to the CPU 52, the number of steps of the stepper motor 66 is counted until the next gap is detected at the trailing edge of the label. Since the distance d1 is known by the CPU 52, the CPU can control the start of printing of the next label in order to minimize top-of-form errors. In a second embodiment of the present invention, two gap sensors 42, 44 are utilized to perform the label length measurement. As set forth above, the two gap sensors 42, 44 are separated by a known fixed distance d2. It should be appreciated that the distance d2 will remain unchanged regardless of the print media type or back tension conditions. Assuming that the distance d2 is less than a length of a label 36, a length measurement can be performed by detecting a leading edge of the label with the first gap sensor 42 in the same manner as described above. Then, the number of steps of the stepper motor 66 are counted until the trailing edge of the label is detected by the second gap sensor 44. It should be appreciated that the second embodiment of the present invention would yield a faster measurement of a label length, although it would entail an increased amount of complexity of the printer.

At step 103, a comparison is made between the measured length of the label and the initial count-up values that were loaded at step 101. To perform this comparison, the data is normalized in terms of a number of clock cycles. For example, if a printer is capable of advancing the print media by five mils per step of the stepper motor 66, and an ideal label length is three inches, then an ideal label length would be six-hundred steps. If the actual measured length were five-hundred ninety steps, rather than six-hundred steps, then the printed image would run over the length of the label. Conversely, if the actual length of the label were six-hundred ten steps, then the printed information would inadequately fill the label, yielding a top-of-form error.

There are three possible outcomes of the decision at step 103. First, step 104 illustrates the condition in which the initial value is greater than the measured value. In this situation, the step/line ratio is decreased at step 107. For example, the step count-up value may be increased to one hundred one, and the line count-up value may be decreased to ninety nine. This way, the stepper motor 66 will step slightly less often over the course of a label 36, while the thermal print head 18 will print lines of data slightly more often.

Conversely, step 106 illustrates the second condition in which the actual measured value is greater than the initial value. In that condition, the step/line ratio is increased at step 108. It should be appreciated that an increase in this ratio will have the exact opposite effect of the decrease in ratio described previously. Third, step 105 illustrates the condition in which the actual and initial values are equal. This third condition reflects that the label accurately matches the ideal length, and that no change to the step/line ratio is required.

Once the step/line ratio has been adjusted at either of steps 107, 108, or if no change is made at step 105, the next label 36 is printed using the revised (or unchanged) count-up values. At step 110, a check is made to see if the print media has reached the end of a roll. If there are still labels remaining on the roll to be printed, the process returns to step 102 and a label length is once again measured. It should be appreciated that a length measurement at step 102 may be occurring simultaneously with a printing of a label 36 so that labels are not wasted during the measurement step. It should also be appreciated that incremental changes may be constantly made to the step count-up value and the line count-up value in order to constantly optimize the printing characteristics for the changing conditions of the printer and the print media. If the end of the media roll is detected at step 110, the method terminates at step 111.

Having thus described a preferred embodiment of an apparatus and method for compensating for printer top-of-form and image stretch errors, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. An apparatus for a printer for compensating for errors that result from step size variations, said apparatus comprising:

a clock adapted to provide a series of regular clock pulses at a fixed rate;

a first counter coupled to said clock for counting said clock pulses, said first counter providing a first interrupt signal coinciding with each of a first number of said clock pulses;

a second counter coupled to said clock for counting said clock pulses, said second counter providing a second interrupt signal coinciding with each of a second number of said clock pulses;

a platen roller driven by at least one step motor to transport a print media in step increments in response to each of said first interrupt signals, said first number of said clock pulses defining timing between successive ones of said step increments;

a print head disposed in proximity to said platen roller permitting transport of said print media therebetween, said print head being activated to print one line of information onto said print media in response to each of said second interrupt signals, said second number of said clock pulses defining timing between successive activations of said print head; and a processor coupled to said first and second counters adapted to alter said first and second numbers to maintain an optimum ratio of step increments taken to lines of information printed to minimize image stretch errors, without interrupting printing operations.

2. The apparatus of claim 1, wherein said print media comprises labels, and said apparatus further comprises a sensor coupled to said processor for sensing at least one of a leading edge and a trailing edge of each label.

3. The apparatus of claim 2 wherein said processor is further adapted to measure an actual length of each label in terms of the number of steps taken by the step motor between the leading and trailing edge of each label.

4. The apparatus of claim 3 wherein said processor increases the ratio of steps taken to lines of information printed when said actual length is greater than an expected number of steps.

5. The apparatus of claim 3 wherein said processor decreases the ratio of steps taken to lines of information printed when said actual length is less than an expected number of steps.

6. The apparatus of claim 3 wherein said processor is further adapted to calculate a number of steps needed to move each label from a known position to a position under said print head in response to variations in said actual length to minimize top-of-form errors.

7. In a printer having a platen roller driven to transport a print media and a print head disposed in proximity to said platen roller permitting transport of said print media therebetween, a method for controlling operation of the printer to compensate for errors associated with step size variations comprises:

providing a series of clock pulses at a fixed rate;

transporting said print media in step increments at a rate coinciding with each of a first number of said clock pulses, wherein said first number of said clock pulses defines a time interval between successive ones of said step increments;

activating said print head to print lines of information onto said print media at a rate coinciding with each of a second number of said clock pulses, wherein said second number of said clock pulses defines a time interval between printing of successive ones of said lines of information; and updating said first and second numbers without interrupting printing operations in a manner that alters the ratio of step increments taken to lines of information printed so as to minimize image stretch errors.

8. The method of claim 7 wherein the step of updating further comprises the steps of:

measuring an actual step increment size of said print media; and comparing said actual step increment size to an expected step increment size.

9. The method of claim 8, wherein the step of measuring further comprises sensing gaps between individual labels of said print media and providing a signal in correspondence with each said gap.

10. The method of claim 9, wherein the step of measuring further comprises counting the number of steps between each of said signals.

11. The method of claim 8 further comprising calculating a number of steps needed to move each label from a known position to a position under said print head in response to variations in said actual step increment size to minimize top-of-form errors.

12. An apparatus for a label printer for providing optimum registration between labels and printed information, said apparatus comprising:

a clock adapted to provide a series of clock pulses at a fixed rate;

a platen roller driven by at least one step motor to transport said labels in step increments in response to first interrupt signals corresponding to a first number of said clock pulses, said first number of said clock pulses defining timing between successive ones of said step increments;

a print head disposed in proximity to said platen roller permitting transport of said labels therebetween, said print head being activated to print a line of information onto said labels in response second interrupt signals corresponding to a second number of said clock pulses, said second number of said clock pulses defining timing between successive activations of said print head;

a sensor disposed a fixed distance from said print head, permitting transport of said labels thereunder, said sensor capable of sensing a leading edge and a trailing edge of each label that passes thereunder; and a processor and program memory storing instructions for controlling said processor, said instructions including:

measuring an actual length of each label in terms of the number of steps taken by the step motor between the leading and trailing edge of each label;

updating said first and second numbers in accordance with said actual length to maintain an optimum ratio of steps taken to lines of information printed to minimize image stretch errors; and calculating a number of steps of the step motor needed to move each label said fixed distance from said sensor to said print head in accordance with said actual length.

13. The apparatus of claim 12 wherein said updating instruction further comprises increasing the ratio between the first and second number if an initial value representing the expected number of steps of each label is greater than the measured value.

14. The apparatus of claim 12 wherein said updating instruction further comprises decreasing the ratio between the first and second number if the measured value is greater than the initial value.

15. An apparatus for a label printer for correcting errors associated with step size variations, said apparatus comprising:

means for providing a series of clock pulses at a fixed rate;

means for transporting said labels in step increments at a rate coinciding with each of a first number of said clock pulses, said first number of said clock pulses defining a time interval between successive ones of said step increments;

means for printing lines of information onto said labels at a rate coinciding with each of a second number of said clock pulses, said second number of said clock pulses defining a time interval between printing of successive ones of said lines of information;

means for detecting a current step size; and means for maintaining an optimum step/line ratio in response to variations of said current step size to minimize image stretch errors by selection of said first and second numbers of said clock pulses.

16. The apparatus of claim 13 further comprising means for calculating a number of steps needed to move each label from a known position to said print head in response to variations of said current step size to minimize top-of-form errors.

* * * * *